US009152076B2

(12) United States Patent
Nishida

(10) Patent No.: US 9,152,076 B2
(45) Date of Patent: Oct. 6, 2015

(54) DEVELOPING APPARATUS, PROCESS CARTRIDGE AND IMAGE FORMING APPARATUS

(75) Inventor: Shinichi Nishida, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 504 days.

(21) Appl. No.: 13/344,957

(22) Filed: Jan. 6, 2012

(65) Prior Publication Data

US 2012/0177401 A1 Jul. 12, 2012

(30) Foreign Application Priority Data

Jan. 11, 2011 (JP) ..... 2011-002776
Nov. 29, 2011 (JP) ..... 2011-260274

(51) Int. Cl.
*G03G 15/08* (2006.01)

(52) U.S. Cl.
CPC ..... *G03G 15/0812* (2013.01); *G03G 15/0817* (2013.01)

(58) Field of Classification Search
CPC ..... G03G 15/0812; G03G 15/0817
USPC ..... 399/103, 105, 111, 264, 281, 284
See application file for complete search history.

(56) References Cited

U.S. PATENT DOCUMENTS 5,073,797 A * 12/1991 Ono et al. ..... 399/105
5,134,960 A * 8/1992 Shirai ..... 399/105
5,212,521 A * 5/1993 Ogawa et al. ..... 399/264
5,592,268 A * 1/1997 Uehara et al. ..... 399/276
5,701,558 A * 12/1997 Kojima ..... 399/103
6,094,550 A * 7/2000 Kido et al. ..... 399/103
6,185,392 B1 * 2/2001 Hoshi ..... 399/102
6,212,343 B1 * 4/2001 Hosokawa et al. ..... 399/102
6,266,500 B1 * 7/2001 Numagami et al. ..... 399/104
6,282,395 B1 * 8/2001 Nittani et al. ..... 399/284
6,321,050 B1 * 11/2001 Sato et al. ..... 399/103
6,336,014 B1 * 1/2002 Sato et al. ..... 399/103
6,721,520 B2 * 4/2004 Higeta et al. ..... 399/109
7,761,028 B2 7/2010 Oguma et al.
2001/0026715 A1 * 10/2001 Tatsumi ..... 399/284
2002/0003974 A1 * 1/2002 Nittani et al. ..... 399/284
2002/0028086 A1 * 3/2002 Sato et al. ..... 399/103
2003/0043361 A1 * 3/2003 Shoji et al. ..... 355/132
2004/0120734 A1 * 6/2004 Okamoto ..... 399/284
2005/0111888 A1 * 5/2005 Kim ..... 399/284
2005/0158070 A1 * 7/2005 Ishii ..... 399/103

(Continued)

FOREIGN PATENT DOCUMENTS

JP 62-192270 A 8/1987
JP 7-333981 A 12/1995

*Primary Examiner* — David Bolduc

(74) *Attorney, Agent, or Firm* — Fitzpatrick, Cella, Harper & Scinto

(57) ABSTRACT

A developing apparatus includes a frame supporting the developing roller; a sealing member provided at each of one and the other ends of the developing device frame and contacted to the developing roller to prevent leakage of the developer; and a developing blade contacted to the developing roller to regulate an amount of the developer carried on the developing roller, the developing blade having a free end in a downstream side with respect to a rotational moving direction of the developing roller, wherein each of one and the other ends of the developing blade is provided with a projected portion projecting in the rotational axis direction between the developing roller and the sealing member.

17 Claims, 4 Drawing Sheets

(56) References Cited

U.S. PATENT DOCUMENTS

| | | | | |
|---|---|---|---|---|
| 2005/0244185 | A1* | 11/2005 | Jeon | 399/103 |
| 2006/0024093 | A1* | 2/2006 | Askren et al. | 399/284 |
| 2007/0116492 | A1* | 5/2007 | Tanabe | 399/103 |
| 2007/0134020 | A1* | 6/2007 | Lee et al. | 399/103 |
| 2007/0280726 | A1* | 12/2007 | Ishii | 399/103 |
| 2008/0112723 | A1* | 5/2008 | Oguma et al. | 399/104 |
| 2009/0060594 | A1* | 3/2009 | Inada et al. | 399/284 |
| 2009/0154950 | A1* | 6/2009 | Kant et al. | 399/103 |
| 2009/0154951 | A1* | 6/2009 | Askren et al. | 399/103 |
| 2009/0180796 | A1* | 7/2009 | Aruga et al. | 399/103 |
| 2009/0245890 | A1* | 10/2009 | Park et al. | 399/284 |
| 2010/0092206 | A1* | 4/2010 | Matsushita et al. | 399/103 |
| 2010/0135701 | A1* | 6/2010 | Lee et al. | 399/284 |
| 2010/0226682 | A1 | 9/2010 | Tanaka et al. | |
| 2011/0236057 | A1* | 9/2011 | Nakajima et al. | 399/103 |

* cited by examiner

DEVELOPING APPARATUS, PROCESS CARTRIDGE AND IMAGE FORMING APPARATUS

FIELD OF THE INVENTION AND RELATED ART

The present invention relates to an image forming apparatus, a developing device for an image forming apparatus, and a process cartridge removably installable in an image forming apparatus.

Generally, developing devices are provided with a development roller and a blade (which hereafter may be referred to as development blade). The development blade regulates the amount by which developer is borne on the development roller, by being placed in contact with the peripheral surface of the development roller. Further, some of these developing devices are structured so that the free edge (regulating edge) of the development blade is on the downstream side, in terms of the rotational direction of the development roller, relative to the base portion of the blade, by which the blade is anchored. This structural arrangement for a developing device, however, requires means for preventing toner from leaking from a developing device through the portions of the device, which are in the adjacencies of the lengthwise ends of the development roller and/or development blade. Thus, a substantial number of inventions have been made to solve this problem. A couple of these inventions are disclosed in Japanese Laid-open Patent Applications S62-192770 and H07-333981.

According to the invention disclosed in Japanese Laid-open Patent Application S62-192770, the developing device is provided with a pair of seals for preventing the leak. More specifically, the seals are shaped so that they perfectly fill the wedge-shaped gaps, one for one, which are between the development blade and development roller, at the lengthwise ends of the device.

In the case of the invention disclosed in Japanese Laid-open Patent Application H07-333981, the developing device is provided with a pair of seals which are in the form of a brush. Each seal fills the wedge-shaped gap between the development blade and development roller, at one of the lengthwise ends of the development device.

The structural arrangements disclosed in the aforementioned patent applications, however, are problematic in that unless the shape of the seal perfectly matches the shape of the gap, and/or if the seal is erroneously installed, it is impossible for the presence of the seal to ensure that the toner does not leak (and scatter) from the developing device.

More specifically, if the seal happens to be smaller than the gap between the development blade and development roller, there remain gaps between the sealing member and development blade, and/or between the sealing member and development roller. On the other hand, if the seal is larger than the wedge-shaped gap between the development blade and development roller, the sealing member lifts the development blade, creating thereby a gap between the development blade and development roller. That is, the inaccuracy in sealing member size (whether sealing member is too small or too large) leaves and/or creates gaps between the development blade and development roller, at the lengthwise ends of the developing device, and these gaps allow the developer in the developing device to leak (scatter) from the lengthwise ends of the device.

SUMMARY OF THE INVENTION

Thus, the primary object of the present invention which was made in consideration of the above described problem is to provide a developing device which is structured so that the free edge (developer regulating edge) of its development blade is on the downstream side, in terms of the rotational direction of the development roller, relative to the base portion of the development blade, by which the blade is anchored, and yet, does not allow to leak toner from its areas corresponding to the lengthwise ends of the development roller.

According to an aspect of the present invention, there is provided a developing apparatus comprising a developing device frame supporting said developing roller; a sealing member provided at each of one and the other ends of said developing device frame with respect to a rotational axis direction of said developing roller and contacted to said developing roller to prevent leakage of the developer; and a developing blade contacted to said developing roller to regulate an amount of the developer carried on said developing roller, said developing blade having a free end in a downstream side with respect to a rotational moving direction of said developing roller, wherein each of one and the other ends of said developing blade with respect to the rotational axis direction is provided with a projected portion projecting in the rotational axis direction between said developing roller and said sealing member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, one of the preferred embodiments of the present invention is described in detail with reference to the appended drawings. However, the measurements, materials, and shapes of the structural components of the developing device, and the positional relationship among the structural components, in the following embodiment of the present invention, are not intended to limit the present invention in scope, unless specifically noted.

Embodiment

Figure 1:
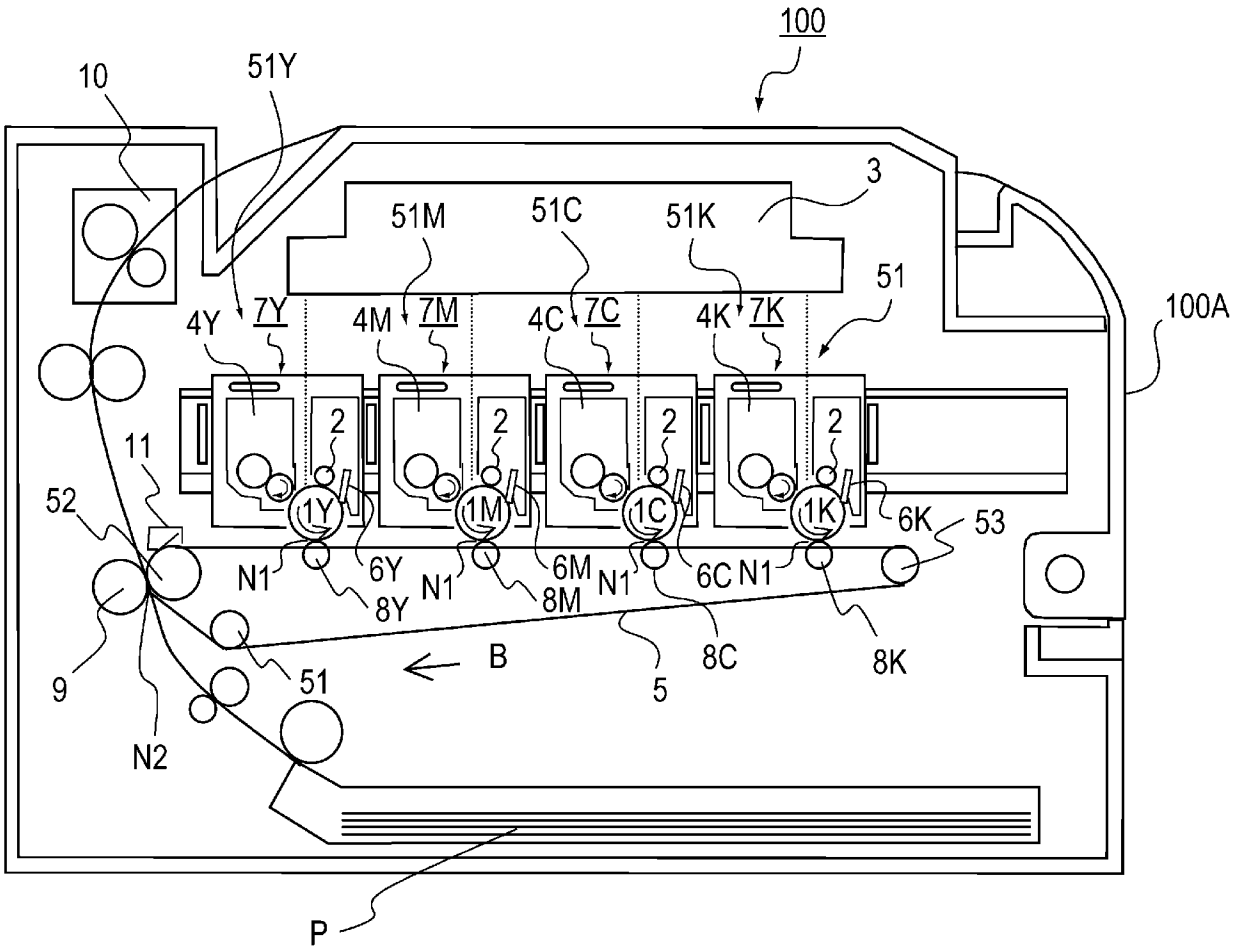
FIG. 1 is a schematic sectional view of the image forming apparatus equipped with the development unit in one of preferred embodiments of the present invention, and shows the general structure of the apparatus.

FIG. 1 is a schematic sectional view of the image forming apparatus 100 in one of the preferred embodiments of the present invention, and shows the general structure of the apparatus 100. The apparatus 100 has development units 4Y-4K which are in accordance with the present invention. It uses one of the known electrophotographic image formation processes. As is evident from FIG. 1, the image forming apparatus 100 has the main assembly 100A (which hereafter is referred to simply as "apparatus main assembly"). It has also the image formation stations 51Y-51K which are in the main assembly 100A. The image formation stations 51Y-51K include photosensitive drums 1Y-1K, primary transfer rollers 8Y-8K, etc., respectively. Each of the photosensitive drums 1Y-1K is an "image bearing member", and each of the primary transfer roller 8Y-8K is a "toner image transferring device".

The image forming apparatus 100 is a full-color laser printer of the so-called inline type. It employs one of the known intermediary transfer mediums. It can form a full-color image on a sheet P of recording medium (for example, ordinary recoding paper, plastic sheet, fabric, and the like), based on the information of an image to be formed. The information of an image to be formed is inputted into the apparatus main assembly 100A from an image reading device which is connected to the apparatus main assembly 100. The information is inputted into the apparatus main assembly 100A also from a host device, such as a personal computer, which is connected with the apparatus main assembly 100A so that information can be exchanged between the image forming apparatus 100 and the host device.

The image forming apparatus 100 has multiple image formation stations, more specifically, the first, second, third, and fourth image formation stations 51Y, 51M, 51C, and 51K for forming yellow (Y), magenta (M), cyan (C), and black (K) monochromatic images, respectively. The first to fourth image formation stations 51Y-51K are sequentially aligned in parallel in the direction perpendicular to the bottom wall of the external shell of the image forming apparatus 100.

The first to fourth image formation stations 51Y-51K are different in the color of the images they form, but are practically the same in structure and operation. Thus, they are going to be described together unless differentiation is necessary for specific reasons. That is, the suffixes Y, M, C, and K assigned to the referential codes to indicate colors may be eliminated.

The image forming apparatus 100 has multiple photosensitive drums 1, more specifically, four photosensitive drums 1Y-1K, which are electrophotographic photosensitive members. The photosensitive drums 1 are aligned in parallel in the direction perpendicular to the bottom wall of the external shell of the apparatus main assembly 100A. The photosensitive drums 1Y-1K are rotated in the direction (counterclockwise direction) indicated by an arrow mark A (FIG. 2) by an unshown driving means (power source).

Further, the image forming apparatus 100 has a scanner unit 3 (exposing device) as an exposing means which forms an electrostatic latent image on the peripheral surface of each of the four photosensitive drums 1 by scanning the peripheral surface of the photosensitive drum 1 with a beam of laser light which it projects while modulating the beam with electrical signals which reflect the information of the image to be formed. The exposing means is in the top portion of the apparatus main assembly 100A.

Each image formation station has a charge roller 2, a development unit 4 (4Y-4K), a cleaning member 6 (6Y-6K), which are in the adjacencies of the peripheral surface of the photosensitive drum 1. The charge roller 2 is a charging means for uniformly charging the peripheral surface of the photosensitive drum 1. The development unit 4 is for developing an electrostatic latent image into a visible image, that is, an image formed of toner (developer) (which hereafter may be referred to simply as toner image). The cleaning member 6 is for removing the transfer residual toner, that is, the toner remaining on the peripheral surface of the photosensitive drum 1 after the toner image transfer.

The image forming apparatus 100 has also an intermediary transfer belt 5 for transferring the toner image from the photosensitive drum 1 onto the sheet P of recording medium. The intermediary transfer belt 5 is positioned so that it faces all of the four photosensitive drums 1. It is going to be described later in more detail.

In terms of the rotational direction of the photosensitive drum 1, the point at which the photosensitive drum 1 is charged by the charge roller 2, point at which the peripheral surface of the photosensitive drum 1 is exposed by the scanner unit 3, point at which an electrostatic latent image is developed, point at which a toner image is transferred onto the intermediary transfer belt 5, and point at which the peripheral surface of the photosensitive drum 1 is cleaned by the cleaning member 6 are in the listed order.

The development unit 4 uses nonmagnetic single-component developer. That is, it uses plain toner. It develops an electrostatic latent image in reverse, by placing its development roller 17 (FIG. 2), as a developer bearing member, in contact with the peripheral surface of the photosensitive drum 1. More concretely, it develops an electrostatic image by adhering charged toner to the portions of the exposed portion of the peripheral surface of the photosensitive drum 1, which were made to attenuate in electrical charge by the exposure. In the case of this image forming apparatus, the toner polarity (negative in this embodiment) is the same as the polarity to which the peripheral surface of the photosensitive drum 1 is charged.

The photosensitive drum 1 and drum processing means, that is, charge roller 2, development unit 4, and cleaning member 6, are integrated in the form of a cartridge (which hereafter may be referred to as process cartridge 7, or simply as cartridge 7). The cartridge 7 is removably mountable in the apparatus main assembly 100A by being assisted by cartridge mounting (removing) means, such as cartridge insertion guides and cartridge positioning members, etc., with which the apparatus main assembly 100A is provided. The cartridges 7 for the four image formation stations 51Y~51K are the same in shape, and contain yellow (Y), magenta (M), cyan (C), and black (K) toners, respectively.

The intermediary transfer belt 5 as an intermediary transferring member is an endless belt. It is in contact with all the photosensitive drums 1, and is circularly moved (rotated) in the direction (clockwise direction) indicated by an arrow mark B. It is supported and kept stretched (tensioned) by multiple belt supporting members, that is, a belt driving roller 51, a roller 52, and a roller 53. The roller 52 is a roller for backing up the intermediary transfer belt 5 against a second transfer roller. It opposes the second transfer roller, with the presence of the intermediary transfer belt 5 between itself and second transfer roller. The rollers 52 and 53 are rotated by the movement of the intermediary transfer belt 5 while supporting the belt 5.

There are four primary transfer rollers 8Y-8K as primary transferring means on the inward side of the loop of the intermediary transfer belt 5. The rollers 8Y-8K are parallel to each other, and oppose the photosensitive drums 1Y-1K, one for one. More specifically, they keep the intermediary transfer belt 5 pressed upon the photosensitive drums 1Y-1K, one for one, forming thereby primary transfer nips N1, in which the intermediary transfer belt 5 contacts the photosensitive drums 1Y-1K. Further, the image forming apparatus 100 is provided with an unshown primary transfer bias power source (high voltage source) as the primary transfer bias applying means for applying bias to the primary transfer rollers 8Y-8K. The bias applied to the primary transfer rollers 8Y-8K is opposite in polarity to the normal polarity to which toner becomes naturally charged. As the voltage is applied to the primary transfer rollers 8, the toner images on the photosensitive drums 1Y-1K are transferred (primary transfer) onto the intermediary transfer belt 5.

Further, the image forming apparatus 100 is provided with a secondary transfer roller 9 as the second transferring means, which is positioned on the outward side of the loop of the intermediary transfer belt 5 so that it opposes the belt backing roller 52. More specifically, the secondary transfer roller 9 is pressed on the belt backing roller 52, with the presence of the intermediary transfer belt 5 between itself and belt backing roller 52, forming thereby the secondary transfer nip N2, in which the intermediary transfer belt 5 is in contact with the secondary transfer roller 9. Further, the image forming apparatus 100 is provided with an unshown second transfer bias power source (high voltage power source) as the second transfer bias applying means, which is for applying bias to the secondary transfer roller 9. As the secondary transfer bias is applied to the secondary transfer roller 9, the toner image(s) on the intermediary transfer belt 5 is transferred (secondary transfer) onto the sheet P of recording medium. Incidentally, the primary transfer rollers 8 and secondary transfer roller 9 are the same in structure.

The image formation sequence carried out by the image forming apparatus 100 is as follows: First, the peripheral surface of the photosensitive drum 1 is uniformly charged by the charge roller 2. Then, the uniformly charged area of the peripheral surface of the photosensitive drum 1 is scanned by (exposed to) the beam of laser light projected from the scanner unit 3 while being modulated with electrical signals which reflect the information of the image to be formed. As a result, an electrostatic latent image which reflects the information of the image to be formed is effected on the peripheral surface of the photosensitive drum 1. Then, the electrostatic latent image is developed by the development unit 4 into a visible image, that is, an image formed of toner. Then, the toner image is transferred (primary transfer) from the photosensitive drum 1 onto the intermediary transfer belt 5 by the function of the primary transfer roller 8.

When the image forming apparatus 100 is in the full-color mode, the above described process is sequentially carried out four times in the first to fourth image formation stations 51Y-51K, once in each station. Thus, four monochromatic toner images, different in color, are sequentially transferred (primary transfer) in layers onto the intermediary transfer belt 5.

Meanwhile, the sheet P of recording medium is conveyed to the secondary transfer nip N2, in synchronism with the movement of the intermediary transfer belt 5. Then, as the sheet P is conveyed through the secondary transfer nip N2, remaining in contact with the intermediary transfer belt 5, the four monochromatic toner images, different in color, are transferred together onto the sheet P by the function of the secondary transfer roller 9 which is kept pressed against the intermediary transfer belt 5 (and belt backup roller 52) with the presence of the sheet P between itself and intermediary transfer belt 5. After the transfer (secondary transfer) of the toner images onto the sheet P, the sheet P is conveyed to the fixing device 10 as the fixing means, and is conveyed through the fixing device 10. As the sheet P is conveyed through the fixing device 10, the fixing device 10 applies heat and pressure to the sheet P and the toner images thereon. Consequently, the toner images become fixed to the sheet P.

The toner which is on the peripheral surface of the photosensitive drum 1 after the primary transfer is removed and recovered by the cleaning members 6 (6Y-6K). The toner which is on the intermediary transfer belt 5 after the secondary transfer is removed by a cleaning device 11 for cleaning the intermediary transfer belt 5. Incidentally, the image forming apparatus 100 is enabled to form a monochromatic image and a multicolor image, with the use of one or more of its four image formation stations 51Y-51K.

Figure 2:
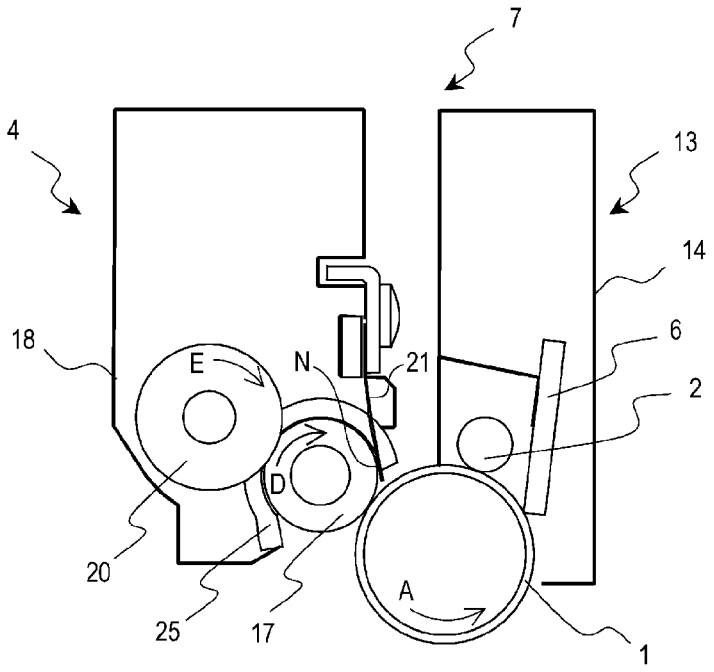
FIG. 2 is an enlarged sectional view of one of the cartridges shown in FIG. 1, and shows the general structure of the cartridge.

FIG. 2 is an enlarged schematic sectional view of the cartridge 7, at a plane perpendicular to the lengthwise direction (axial line) of the photosensitive drum 1. It shows the general structure of the cartridge 7. Next, the cartridge 7, which comprises the development unit 4 and is removably mountable in the apparatus main assembly 100A, is described about its structure, with reference to FIG. 2.

In the following description of the structures and operations of the development unit (developing device) and cartridge 7 in this embodiment of the present invention, terms "up", "down", "vertical", "horizontal", etc., which indicate directions, are used with the assumption that the development unit 4 and cartridge 7 are in their normal attitude in which they are when they are in use, unless specifically noted. That is, the normal attitudes in which the development unit 4 (developing device) or cartridge 7 are when they are in use are the attitudes in which they are after their proper mounting into their proper positions in the apparatus main assembly 100A and are literally ready for image formation. All cartridges 7Y-7K are virtually the same in structure and operation, although they are different in the type (color) of the toner therein.

The cartridge 7 has: a photosensitive member unit 13 which has the photosensitive drum 1, etc.; and the development unit 4 which has the development roller 17, etc.

The photosensitive member unit 13 has a frame 14 which supports various internal components of the photosensitive member unit 13. The frame 14 functions also as the storage for the residual toner. It rotatably supports the photosensitive drum 1, with the presence of unshown bearings between itself and the photosensitive drum 1. The photosensitive drum 1 is rotated in the direction indicated by an arrow mark A (counterclockwise direction), in synchronism with the progression of an image forming operation, by the driving force transmitted to the photosensitive member unit 13 from an unshown motor as the driving force providing means (power source).

The photosensitive drum 1 plays the central role in the image formation process. It is an organic photosensitive drum. It is made up of an aluminum cylinder, and three functional layers, that is, an undercoat layer, a carrier generation layer, and a carrier transfer layer, which are coated in layers in the listed order on the peripheral surface of the aluminum cylinder. The photosensitive drum 1 is 200 mm/s in rotational speed.

There are the cleaning member 6 and charge roller 2, in the adjacencies of the peripheral surface of the photosensitive drum 1, being in contact with the peripheral surface of the photosensitive drum 1. The transfer residual toner, that is, the toner remaining on the peripheral surface of the photosensitive after the first transfer, is removed by the cleaning member 6, and is stored in the frame 14. That is, as the transfer residual toner on the peripheral surface of the photosensitive drum 1 is removed by the cleaning member 6, it falls into the frame 14 and remains therein.

The charge roller 2, which is a charging means, is kept pressed upon the peripheral surface of the photosensitive drum 1 so that its electrically conductive elastic layer is pressed upon the peripheral surface of the photosensitive drum 1. It is rotated by the rotation of the photosensitive drum 1. During an image forming operation, −1100 V of DC voltage, relative to the photosensitive drum 1, is applied to the metallic core of the charge roller 2, whereby the peripheral surface of the photosensitive drum 1 is uniformly charged to a potential level of roughly −550 V, that is, the pre-exposure voltage.

Next, the uniformly charged area of the peripheral surface of the photosensitive drum 1 is exposed to the beam of laser light projected from the above described scanner unit 3 while being modulated with the electrical signals which reflect the data of the image to be formed. As a given point of the uniformly charged area of the peripheral surface of the photosensitive drum 1 is exposed to the beam of laser light, it is made to lose its potential by the carrier from the carrier generation layer. That is, it reduces in potential. More specifically, its potential reduces to −100 V. In other words, various points of the uniformly charged area of the peripheral surface of the photosensitive drum 1 are reduced in potential to −100 V. Consequently, an electrostatic latent image is effected on the uniformly charged area of the photosensitive drum 1. The points of the latent image, which correspond to the exposed points, are −100 V (V1) in potential level, and the points of the latent image, which correspond to the unexposed points, are −550 V (Vd) in potential level.

As for the development unit 4, it has a frame 18 which supports various internal components of the development unit 4. The development unit 4 has the development roller 17 which is rotated in the direction (clockwise direction) indicated by an arrow mark D while being kept in contact with the peripheral surface of the photosensitive drum 1. The development roller 17, which is a "developer bearing member", is a roller that develops the electrostatic image on the image bearing member by rotating while bearing developer on its peripheral surface. The image forming apparatus 100 is structured so that as the development roller 17 and photosensitive drum 1 are rotated, the peripheral surface of the development roller 17 and the peripheral surface of the photosensitive drum 1 move in the same direction (downward in this embodiment) in the area of contact between the development roller 17 and photosensitive drum 1. The development roller 17 is rotatably supported by the frame 18 (development unit frame), by its lengthwise ends (in terms of direction parallel to its axial line), with the presence of unshown development unit plates between the development roller 17 and frame 18.

In the case of the development unit 4 in this embodiment, the peripheral surface of development roller 17 is kept in contact with the peripheral surface of the photosensitive drum 1. However, the image forming apparatus 100 may be structured so that a preset amount of gap is kept between the peripheral surface of the development roller 17 and the peripheral surface of the photosensitive drum 1.

To the development roller 17, −350 V of DC voltage (bias) is applied, and the toner in the development unit 4 is frictionally charged to the negative potential. Thus, in the development station, that is, where the negative charged toner on the peripheral surface of the development roller 17 comes into contact with the peripheral surface of the photosensitive drum 1, the difference in potential level between the toner and the development roller 17 causes the toner to transfer onto only the exposed points of the peripheral surface of the photosensitive drum 1, that is, the points with the reduced potential. Consequently, the electrostatic image is developed into a visible image made of toner. In other words, the development system in this embodiment is one of the so-called reverse development systems.

The development roller 17 is a so-called elastic development roller, which is made up of a metallic core, and a cylindrical elastic layer formed on the peripheral surface of the metallic core. More specifically, the development roller 17 is made up of a metallic core, the first layer (base layer), and the second layer (surface layer). The metallic core is formed of stainless steel, and is 6 mm in diameter. The second layer is formed of solid rubber made by dispersing carbon particles in silicone rubber. It is roughly 3 mm in thickness. The second layer is formed of urethane adjusted in electrical resistance by electrically conductive agent. It is formed on the peripheral surface of the first layer to a thickness of roughly 10 μm. The peripheral velocity of the development roller 17 is set to be to roughly 1.3 times faster than that of the photosensitive drum 1.

The development unit 4 is provided with a developer supply roller 20 for supplying the peripheral surface of the development roller 17 with developer. The developer supply roller 20 is positioned so that its peripheral surface is in contact with the peripheral surface of the development roller 17. It is rotated in the direction (clockwise direction) indicated by an arrow mark E, that is, the direction which makes the peripheral surface of the development roller 17 move in the opposite direction from the developer supply roller 20, at the interface between the peripheral surface of the development roller 17 and the peripheral surface of the developer supply roller 20. Not only does the developer supply roller 20 supply the peripheral surface of the development roller 17 with toner, but also, it strips the peripheral surface of the development roller 17 of the residual toner, that is, the toner which was not consumed for development, and therefore, are remaining on the peripheral surface of the development roller 17. Further, the development unit 4 is provided with a development blade 21 which regulates in thickness the toner layer, by being placed virtually in contact with the peripheral surface of the development roller 17, as the toner layer is formed on the peripheral surface of the development roller 17, of the toner supplied to the peripheral surface of the development roller 17 by the developer supply roller 20.

The developer supply roller 20 is made up of an electrically conductive metallic core, and a cylindrical foamed layer (which hereafter may be referred to simply as foamed layer) formed on the peripheral surface of the metallic core, of a foamed substance, the cells of which are continuous. The foamed layer of the developer supply roller 20 plays two roles, that is, a role of supplying the development roller 17 with toner, and a role of stripping away the toner which did not contribute to the development. Regarding the stripping of the toner on the peripheral surface of the development roller 17, the edge of each of the numerous cells of the foamed layer rubs the peripheral surface of the development roller 17, whereby the residual toner is mechanically stripped away by the edge.

More concretely, the metallic core of the developer supply roller 20 is 5 mm in external diameter. The cylindrical layer is an elastic sponge roller which is formed of relatively soft polyurethane foam. It is 5.5 mm in thickness (300-450 μm in cell diameter), and 16 mm in external diameter. Since the surface layer of the developer supply roller 20 is made of the foamed substance whose cells are continuous, the peripheral surface of the supply roller 20 is provided with peaks and valleys of the proper dimensions for the developer supply roller 20. Therefore, it is unnecessary for a large amount of pressure to be applied to the developer supply roller 20 in order to satisfactorily strip away the toner remaining on the peripheral surface of the development roller 17, that is, the toner which was not consumed for the development.

The choices of the substance for providing the peripheral surface of the developer supply roller 20 with the scraping edges provided by the cellular structure of the substance do no need to be limited to urethane foam. That is, substances other than urethane foam can also be used as the material for the foamed layer. For example, NBR rubber, silicone rubber, acrylic rubber, hydrin rubber, ethylene propylene rubber (EPDM), compounds of the preceding substances, ordinary rubbers, etc., can be used as the material for the surface layer of the develop supply roller 20. Further, the chloroprene rubber, styrene butadiene rubber, isoprene rubber, acrylnitrylbutadiene rubber, compounds of preceding substances, etc., are also usable as the material for the surface layer of the developer supply roller 20. As for the substance for providing a proper amount of electrical resistance, one of the known electrically conductive ionic agents, inorganic microscopic particles, carbon black, or the like may be dispersed in the material for the surface layer of the developer supply roller 20.

Further, such bias that works in the direction to move the toner from the developer supply roller 20 to the development roller 17 may be applied to the supply roller 20 in order to assist the toner movement. That is, the amount by which toner is borne on the peripheral surface of the development roller 17, on the upstream side of the development blade 21 in terms of the rotational direction of the development roller 17, can be increased by applying to the developer supply roller 20 the bias that works in the direction to induce the negatively charged toner to move toward the development roller 17. In addition, the application of such bias is likely to increase in toner density the toner layer as the toner layer is formed on the peripheral surface of the development roller 17. In other words, even if the peripheral surface of the development roller 17 is relatively less rough, a developer layer is likely to become uniform in toner density as it is formed on the peripheral surface of the development roller 17.

The development unit 4 is structured so that in the area in which the peripheral surface of developer supply roller 20 is in contact with the peripheral surface of the development roller 17, the peripheral surface of the supply roller 20 moves in the opposite direction from the peripheral surface of the development roller 17 (so-called counter rotation). The peripheral velocity of the developer supply roller 20 was 0.85 time that of the development roller 17.

Figure 3:
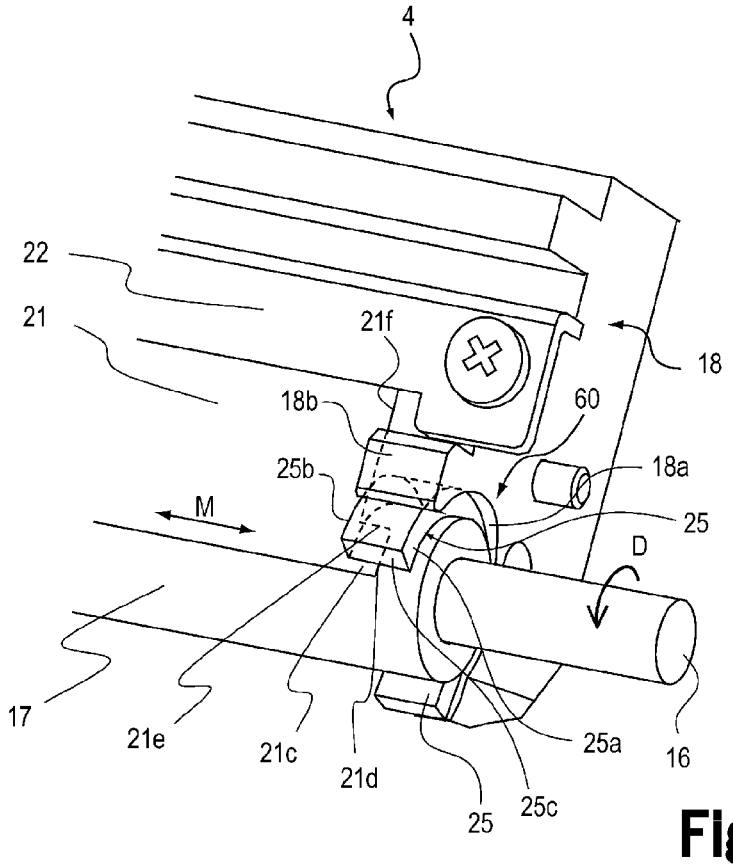
FIG. 3 is a schematic perspective view of one of the lengthwise ends of the development unit of the cartridge shown in FIG. 2.

FIG. 3 is a schematic perspective view of one of the lengthwise end portions of the development unit 4, from which the development unit 4 is driven. It shows the structure of the lengthwise portion of the development unit 4. As is evident from FIG. 3, the development unit 4 is provided with a pair of seal seating surface 18*a*, which are at the ends of the development unit frame 18, one for one, in terms of the direction parallel to the lengthwise direction of the development roller 17. Further, the development unit 4 is provided with a pair of seals 25, which are attached to the seal seating surfaces 18*a* (which hereafter will be referred to simply as seal seats 18*a*), one for one. The seal seats 18*a* are semi-cylindrical, and the development roller 17, which is rotatable about its rotational axis, fits in the concaves which the seal seats 18*a* form; the lengthwise ends of the development roller 17 fit in the concaves which the two seal seats 18*a* form. The development roller 17 is rotated in the direction indicated by the arrow mark D.

To the development unit frame 18, the development blade 21 is solidly attached. The development blade 21, which is a "regulating member", is placed in contact with the development roller 17 to control the amount by which the developer is allowed to remain on the peripheral surface of the development roller 17 after being borne by the development roller 17. The development blade 21 is made of an elastic substance, and is attached to a blade supporting metallic plate 22, which is supported like a cantilever, by the development unit frame 18. More specifically, the development blade 21 is supported by the development unit frame 18, with the presence of the blade supporting metallic plate 22 between the blade 21 and development unit frame 18, so that in terms of the rotational direction of the development roller 17 indicated by the arrow mark D, the free edge of the development blade 21, that is, the developer controlling edge of the development blade 21, is on the downstream side relative to the base portion of the development blade 21, by which the development blade 21 is attached to the blade supporting metallic plate 22, and also, so that the closer to the free edge of the development blade 21, the smaller the distance between the development blade 21 and the peripheral surface of the development roller 17. Also in terms of the rotational direction of the development roller 17 indicated by the arrow mark D, the development blade 21 is positioned so that its free edge (controlling edge) is in contact with the development roller 17, on the downstream side of the developer supply roller 20 (FIG. 2).

As the development roller 17 rubs the development blade 21, the toner in the developer layer on the peripheral surface of the development roller 17 is frictionally charged, and the developer layer is regulated in thickness. Further, the development blade 21 is being supplied with a preset voltage (−550 V) from an unshown blade bias power source.

The development blade 21 has the main portion and a pair of small tabs 21*c*. The main portion is roughly in the form of a thin rectangular plate. The pair of small tabs 21*c* project from the lengthwise ends of the main portion, one for one, outward of the development unit 4, in the lengthwise direction M which is parallel to the rotational axis 16 of the development roller 17. Although FIG. 3 shows only one of the small tabs (projection) 21*c*, the other small tabs 21*c* (projection) is the same in shape.

As described above, the development blade 21 has the pair of small tabs 21*c* (projections) which extend outward of the development unit 4 from the lengthwise ends of the main portion of the development blade 21 in the lengthwise direction M of the development roller 17. The development unit 4 is structured so that the tabs 21*c* are between the development roller 17 and seal 25. That is, listing from the inward side of the development unit 4 in terms of the radius direction of the development roller 17, the development roller 17, tab 21*c* (projection), and seal 25 are in the listed order. The seal 25 and tab 21*c* are in contact with each other. Further, the tab 21*c* and the peripheral surface of the development roller 17 are hermetically in contact with each other, at least at contact nips 26 between the two (FIG. 4(*c*)).

Referring to FIG. 3, designated by a referential code 21*f* is one of the lengthwise ends of the base side of the development blade 21, and designated by a referential code 21*d* is one of the lengthwise ends of the free edge side of the development blade 21, that is, the outward edge of the aforementioned outwardly extending small tab 21*c*. The outward edge 21*d* may be defined as the outermost edge of the outwardly extending tab 21*c* in terms of the lengthwise direction M.

Also in terms of the lengthwise direction M, the outward edge 21*d* is on the inward side relative to the outward surface 25*a* of the seal 25.

Further, the development blade 21 has an edge 21*e* which extends outward, in terms of the lengthwise direction M, from the outward edge 21*f* to the outermost edge 21*d*. That is, the edge 21*e* may be defined as the upstream edge of the tab 21*c* in terms of the rotational direction (indicated by arrow mark D) of the development roller 17. Also in terms of the lengthwise direction M, the upstream edge 21*e* is within the nip 26 (FIG. 4(*c*)) between the development roller 17 and development blade 21. That is, the upstream edge 21*e* is sandwiched between the development roller 17 and development blade 21, being in contact with both the development roller 17 and development blade 21.

Designated by a referential code 25*c* is the "downstream end" of the seal 25 in terms of the rotational direction of the development roller 17. The downstream end 25*c* is on the downstream side relative to the upstream edge 21*e* of the tab 21*c* of the development blade 21 in terms of the rotational direction of the development roller 17.

The material for the development blade 21 in this embodiment is a piece of thin plate of copper phosphate, which is 0.1 mm in thickness. However, a thin plate of stainless steel, a rubbery substance such as urethane, or the like can also be used as the material for the development blade 21.

Next, the seal 25, which is placed in the gap between the development unit frame 18 and development roller 17 is described about its structure. The development unit 4 is provided with the pair of seals 25 (which are for sealing development unit at lengthwise ends of development unit 4), which are placed in the spaces, one for one, surrounded by the inward surfaces (seal seating surfaces 18*a*) of the development unit frame 18 and the peripheral surface of the development roller 17. More concretely, the development unit 4 is provided with the pair of seals 25, which are at the ends of the development unit 4, one for one, in terms of the lengthwise direction of the development roller 17. The seals 25 are the members for preventing the toner (developer) in the development unit 4 from leaking out of the unit 4, through the gaps between the development roller 17 and development unit frame 18.

The development unit frame 18 is provided with the pair of seal seats 18*a* as described above. The development unit frame 18 is structured so that there will be a preset amount of gap 60 between each seal seat 18*a* and the peripheral surface of the development roller 17. The seal 25 is pasted to the seal seat 18*a*. The development unit frame 18 is structured so that the amount of the gap 60 is less than the thickness of the seal 25. Thus, as the development unit frame 18 is assembled, the seal 25 is compressed by the peripheral surface of the development roller 17 and the seal seat 18*a* (to which seal 25 is pasted), being thereby enabled to prevent the toner from leaking out of the development unit 4 along the peripheral surface of the development roller 17.

In this embodiment, the amount of the gap between the peripheral surface of the development roller 17 and the seal seat 18*a* of the development unit frame 18 was set to 2 mm. The seal 25 was a piece of felt, which was 2.5 mm in thickness. Thus, after the assembly of the development unit 4, the seal 25 remains compressed by 0.5 mm by the peripheral surface of the development roller 17 and the seal seat 18*a* of the development unit frame 18.

Next, referring to FIG. 3, the seal 25 is not between the development blade 21 and development roller 17. In terms of the lengthwise direction M, the seal 25 is adjacent to the space between the development blade 21 and development roller 17. Also in terms of the lengthwise direction M, the protruding portion 18*b* of the development unit frame 18, which has the seal seat 18*a*, is in the adjacencies of the space between the development blade 21 and development roller 17. In terms of the radius direction of the development roller 17, the protruding portion 18*b* is in the adjacencies of the outward surface of the seal 25.

Figure 4:
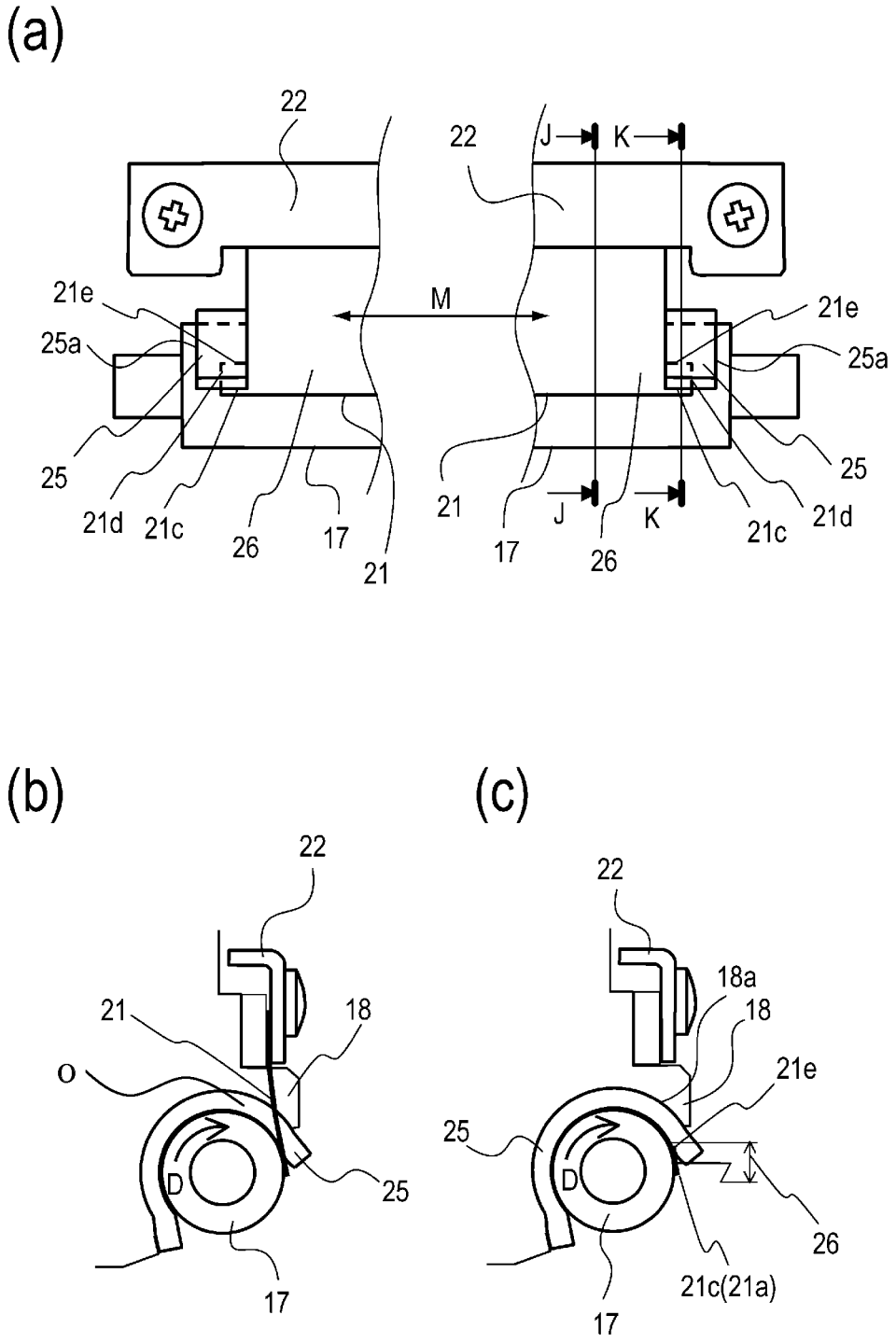
FIGS. 4(*a*), 4(*b*), and 4(*c*) are: a plan view of the lengthwise ends of the development unit, as seen from the direction of the photosensitive member unit 13; a sectional view of the combination of the development roller 17, seal 25, development blade 21, development unit frame 18, and development blade supporting metallic plate 22, at a plane J-J in FIG. 4(*a*); and a sectional view of the combination of the development roller 17, seal 25, development blade 21, development unit frame 18, and development blade supporting metallic plate 22, at a plane K-K in FIG. 4(*a*), respectively.

FIG. 4(*a*) is a schematic plan view of the lengthwise end portions of the development unit 4 as seen from the direction of the photosensitive member unit 13. FIG. 4 does not show the portions of the development unit 4, which are on the outward side of the development blade 21 in terms of the radius direction of the development roller 17. Next, referring to FIG. 4, the positional relationship between the development blade 21 and seal 25 in terms of the lengthwise direction M is described. FIG. 4(*b*) is a sectional view of the combination of the development roller 17, seal 25, development blade 21, development unit frame 18, and development blade supporting metallic plate 22, at a plane J-J in FIG. 4(*a*). FIG. 4(*c*) is a sectional view of the combination of the development roller 17, seal 25, development blade 21, development unit frame 18, and development blade supporting metallic plate 22, at a plane K-K in FIG. 4(*a*).

Referring to FIG. 4(*a*), the development blade 21 has the small tabs 21*c* which extend outward from the lengthwise ends of the main portion of the blade 21, one for one, in terms of the lengthwise direction of the development blade 21. Further, these tabs 21*c* are on the free edge side of the development blade 21.

In terms of the lengthwise direction M, the outward edge 21*d* of each tab 21*c* is on the inward side of the outward surface 25*a* of the seal 25. That is, the seal 25 has an area which is preset in dimension in terms of the lengthwise direction M, is on the outward side of the outward edge 21*d*, in terms of the lengthwise direction M, and is hermetically in contact with the peripheral surface of the development roller 17. In this embodiment, the dimension of the seal 25 in terms of the lengthwise direction M is 6 mm, and the length by which the tab 21*c* and seal 25 overlap with each other in the lengthwise direction M is 3 mm. That is, the seal 25 is hermetically in contact with the peripheral surface of the development roller 17, on the outward side of the outward edge 21*d* in terms of the lengthwise direction M, and the length of the physical contact between the seal 25 and the peripheral surface of the development roller 17 in terms of the lengthwise direction M is 3 mm. This is how the seals 25 are kept hermetically in contact with the peripheral surface of the development roller 17.

Figure 5:
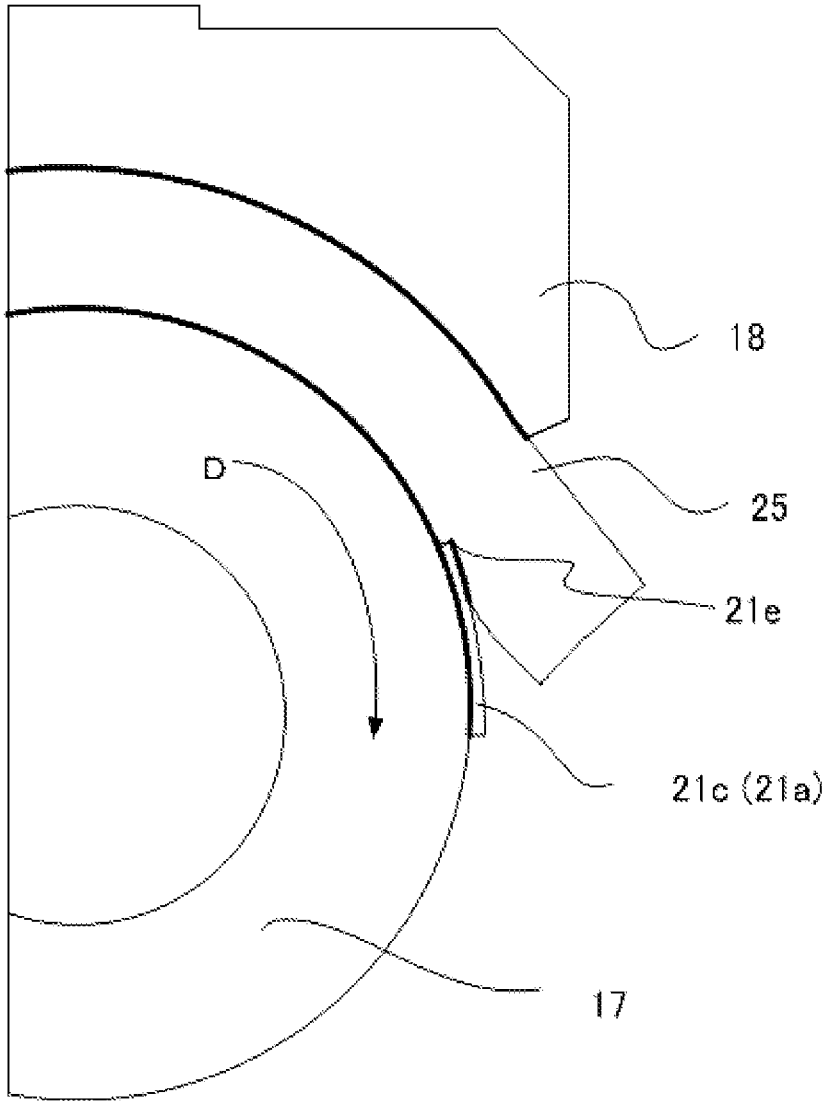
FIG. 5 is an enlarged schematic sectional view of the development unit 4 at a plane perpendicular to the lengthwise direction of the development unit 4.

Next, referring to FIGS. 4(*c*) and 5, the state of contact between the seal 25 and other members of the development unit 4 is described, starting from the upstream side of the rotational direction of the development roller 17 indicated by the arrow mark D. FIG. 5 is an enlarged schematic sectional view of the development unit 4 at a plane perpendicular to the lengthwise direction M. In terms of the radius direction of the development roller 17, the outward surface of the seal 25 is hermetically in contact with the development unit frame 18, between the upstream and downstream edges of the seal seat 18*a* of the development unit frame 18 in terms of the rotational direction of the development roller 17. Further, the upstream portion of the inward surface of the seal 25 is directly in contact with the peripheral surface of the development roller 17, whereas the downstream portion of the seal 25 is hermetically in contact with the upstream edge 21*e* and its adjacencies of the outward surface of the tab 21*c*. In other words, the tab 21*c* is sandwiched between the seal 25 and development roller 17.

Further, the development unit 4 is structured so that the amount of the gap between the upstream edge 21*e* of the tab 21*c* and the seal seat 18*a* of the development unit frame 18 is less than the thickness of the seal 25. Therefore, the seal 25 is kept hermetically in contact with the upstream edge 21*e* and its adjacencies of the tab 21*c*, and keeps the tab 21*c* pressed upon the peripheral surface of the development roller 17.

Further, the development unit 4 is structured so that in terms of the rotational direction of the development roller 17, the seal 25 extends downstream beyond at least the upstream edge 21*e* of the tab 21*c*, for the following reason. That is, if the size and shape of the seal 25 are such that in terms of the rotational direction of the development roller 17, the downstream end of the seal 25 is on the upstream side of the upstream edge 21*e* of the tab 21*c* of the development blade 21, the tab 21*c* is not sandwiched by the seal 25 and development roller 17.

As described above, the seal 25 is seamlessly in contact with the peripheral surface of the development roller 17 and the tab 21*c* of the development blade 21. Thus, the gaps 60, which are between the seal seat 18*a* of the development unit frame 18 and the peripheral surface of the development roller 17 at the lengthwise ends of the seal 25, one for one, in terms of the lengthwise direction M, remain satisfactorily sealed by the pair of seals 25 alone. Thus, the toner in the development unit 4 is unlikely to leak out of the development unit 4 and scatter, at the lengthwise ends of the development unit 4 along the peripheral surface of the development roller 17.

In this embodiment, the development unit 4 is structured so that the development blade 21 is held, like a cantilever, to the blade supporting plate 22 in such a manner that its free edge (developer regulating edge) is on the downstream side relative to its base portion in terms of the rotational direction of the development roller 17. That is, the free edge faces downstream in terms of the rotational direction of the development roller 17. Since the development unit 4 is structured as described above, there is a wedge-shaped space O between the development blade 21 and the peripheral surface of the development roller 17, as shown in FIG. 4(*b*). More specifically, the space O between the development blade 21 and development roller 17 is shaped so that the more upstream from the contact nip 26 between the development blade 21 and the peripheral surface of the development roller 17, the greater the distance between the development blade 21 and the peripheral surface of the development roller 17.

If the development blade 21 is shaped so that after the assembly of the development unit 4, the position of the tab 21*c* of the development blade 21 corresponds to where the gap between the development blade 21 and development roller 17 is relatively large, the tab 21*c* is on the base side of the development blade 21 relative to the position of the tab 21*c* shown in FIG. 3. Thus, the portion of the seal 25, which is on the outward side of the outward edge 21*d* of the tab 21*c*, in terms of the lengthwise direction M, and comes hermetically in contact with the peripheral surface of the development roller 17, has to be increased in its dimension in terms of the lengthwise direction M. Thus, if it is gently that the tab 21*c* of the development blade 21 has to be pressed upon the peripheral surface of the development roller 17, from its base portion to the outward edge 21*d*, the seal 25 has to be increased in its dimension in terms of the lengthwise direction M.

Thus, from the standpoint of reducing in size the aforementioned wedge-shaped space O, that is, from the standpoint of toner leak prevention, it is advantageous to shape the development blade 21 so that after the assembly of the development unit 4, the upstream edge 21*e* of its tab 21*c* is near the contact nip 26. Incidentally, if the development blade 21 is shaped so that after the assembly of the development unit 4, the upstream edge 21*e* of its tab 21*c* is near the contact nip 26, the seal 25 does not need to be as wide, in terms of the lengthwise direction M, as it has to be if the development blade 21 is shaped otherwise.

The aforementioned component measurements are nothing but examples, and are not intended to limit the present invention in scope.

As described above, according to the structural arrangements in this embodiment, even if the development unit 4 suffers from assembly errors related to the sealing of the development unit 4, the phenomenon that toner leaks out of the development unit 4 at the ends of the development roller 17 in terms of the lengthwise direction M is prevented. In particular, unlike the prior art which places the seal 25 in the space between the development blade 21 and development roller 17, the seal 25 blocks the space between the development blade 21 and development roller 17 in the lengthwise direction M, while pressing on the tabs 21 of the development blade 21. Therefore, even if a given development unit 4 suffers from assembly errors related to sealing, it does not suffer from the phenomenon that the space between its development blade 21 and development roller 17 becomes greater than a preset dimension, and/or the phenomenon that the development blade 21 separates from the peripheral surface of the development roller 17.

Further, according to the structural arrangement in this embodiment, the outward edge 21*d* is on the inward side of the outward surface 25*a* in terms of the lengthwise direction M. Thus, the tab 21*c*, which extends in the lengthwise direction M, is placed hermetically in contact with the peripheral surface of the development roller 17, preventing thereby toner from scattering, and the seal 25 is hermetically in contact with the peripheral surface of the development roller 17, on the outward side of the tab 21*c*, preventing thereby toner from scattering.

Further, according to the structural arrangement in this embodiment, the development blade 21 is made up of the roughly rectangular main portion, and the pair of small tabs 21*c* which extend outward from the lengthwise ends of the main portion, one for one, in the lengthwise direction M. Further, the tabs 21*c* are on the free edge (toner layer regulating edge) side of the development blade 21. Further, referring to FIG. 4(*c*), the development unit 4 is structured so that after its assembly, the upstream edge 21*e* of each tab 21*c* will be in the contact nip 26. Thus, the wedge-shaped spaces can be reduced in size by the tabs 21*c*. Further, the seal 25 is seamlessly in contact with both the peripheral surface of the development roller 17 and the tab 21*c* of the development blade 21. Thus, the gaps which are present adjacent to the peripheral surface of the development roller 17 at the ends of the development unit 4 in terms of the lengthwise direction M remain satisfactorily sealed by the seal 25 alone.

Further, the seal 25 is provided with the main portion which hermetically contacts the peripheral surface of the development roller 17, and a portion which extends upstream from the upstream end of the main portion in terms of the rotational direction of the development roller 17. The extending portion sandwiches the upstream edge 21*e* and its adjacencies of the tab 21*c*, between itself and the peripheral surface of the development roller 17. Further, the development unit frame 18 is structured so that the amount of the gap 60 between the portion of the development unit frame 18, which corresponds in position to the upstream edge 21*e* of the tab 21*c*, and the seal seat 18*a*, is less than the thickness of the seal 25. Therefore, the seal 25 is made to contact with the upstream edge 21*e* of the tab 21*c*, and press the tab 21*c* upon the peripheral surface of the development roller 17. As described above, the development unit 4 is not structured to place the seal 25 in the gap 60 between the development blade 21 and development roller 17 so that the seal 25 is sandwiched by the development blade 21 and development roller 17. Therefore, it is possible to prevent toner from leaking out of the development unit 4 through the gap 60 which occurs as the sealing member 25 lifts the development blade 21.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 002776/2011 and 260274/2011 filed Jan. 11, 2011 and Nov. 29, 2011, respectively which are hereby incorporated by reference.

What is claimed is:

1. A developing apparatus comprising:

a developing roller rotatably carrying a developer to develop an electrostatic image formed on an image bearing member;

a developing device frame supporting said developing roller and configured to include a developer accommodating portion for accommodating the developer;

a sealing member provided at each of first and second opposite ends of said developing device frame with respect to a rotational axis direction of said developing roller and in contact with said developing roller to prevent leakage of the developer; and a developing blade in contact with said developing roller to regulate an amount of the developer carried on said developing roller, wherein said developing blade has a free end at a downstream side with respect to a rotational moving direction of said developing roller, a longitudinal end portion with respect to a lengthwise direction of said developing roller, a projection projecting from said longitudinal end portion in the lengthwise direction, an opposing surface opposed to said developing roller and a non-opposing surface opposite from said opposing surface, wherein said sealing member extends to ride on said projection from an upstream side of said projection with respect to the rotational direction of said developing roller so as to extend from the opposing surface side to the non-opposing side of said developing blade, and said sealing member urges said projection to said developing roller.

2. An apparatus according to claim 1, wherein an outer end of said projected portion is disposed inside an outer end of said sealing member with respect to the lengthwise direction.

3. An apparatus according to claim 1, wherein an upstream end of said projected portion with respect to a rotational moving direction of said developing roller is sandwiched by said developing roller and said sealing member.

4. An apparatus according to claim 1, wherein a downstream end of said sealing member with respect to the rotational moving direction of said developing roller is disposed downstream of an upstream end of said projected portion.

5. A process cartridge detachably mountable to a main assembly of an image forming apparatus, said process cartridge comprising:

a photosensitive drum for bearing an electrostatic image;

a developing roller rotatably carrying a developer to develop an electrostatic image formed on said image bearing member;

a developing device frame supporting said developing roller and configured to include a developer accommodating portion for accommodating the developer;

a sealing member provided at each of first and second opposite ends of said developing device frame with respect to a rotational axis direction of said developing roller and in contact with said developing roller to prevent leakage of the developer; and a developing blade in contact with said developing roller to regulate an amount of the developer carried on said developing roller, wherein said developing blade has a free end at a downstream side with respect to a rotational moving direction of said developing roller, a longitudinal end portion with respect to a lengthwise direction of said developing roller, a projection projecting from said longitudinal end portion in the lengthwise direction, an opposing surface opposed to said developing roller and a non-opposing surface opposite from said opposing surface, wherein said sealing member extends to ride on said projection from an upstream side of said projection with respect to the rotational direction of said developing roller so as to extend the opposing surface side to the non-opposing side of said developing blade, and said sealing member urges said projection to said developing roller.

6. A process cartridge according to claim 5, wherein an outer end of said projected portion is disposed inside an outer end of said sealing member with respect to the lengthwise direction.

7. A process cartridge according to claim 5, wherein an upstream end of said projected portion with respect to a rotational moving direction of said developing roller is in contact with said developing roller and said sealing member.

8. A process cartridge according to claim 5, wherein a downstream end of said sealing member with respect to the rotational moving direction of said developing roller is disposed downstream of an upstream end of said projected portion.

9. An image forming apparatus for forming an image on a recording material, said image forming apparatus comprising:

a photosensitive drum for bearing an electrostatic image;

a developing roller rotatably carrying a developer to develop an electrostatic image formed on said image bearing member;

a developing device frame supporting said developing roller and configured to include a developer accommodating portion for accommodating the developer;

a sealing member provided at each of first and second opposite ends of said developing device frame with respect to a rotational axis direction of said developing roller and in contact with said developing roller to prevent leakage of the developer;

a developing blade in contact with said developing roller to regulate an amount of the developer carried on said developing roller, at a downstream side with respect to a rotational moving direction of said developing roller, and a transferring device for transferring a developer image formed on said photosensitive drum, wherein said developing blade has a free end at a downstream side with respect to a rotational moving direction of said developing roller, a longitudinal end portion with respect to a lengthwise direction of said developing roller, a projection projecting from said longitudinal end portion in the lengthwise direction, an opposing surface opposed to said developing roller and a non-opposing surface opposite from said opposing surface, wherein said sealing member extends to ride on said projection from an upstream side of said projection with respect to the rotational direction of said developing roller so as to extend from the opposing surface side to the non-opposing side of said developing blade, and said sealing member urges said projection to said developing roller.

10. An apparatus according to claim 9, wherein an outer end of said projected portion is disposed inside an outer end of said sealing member with respect to the lengthwise direction.

11. An apparatus according to claim 9, wherein an upstream end of said projected portion with respect to a rotational moving direction of said developing roller is sandwiched by said developing roller and said sealing member.

12. An apparatus according to claim 1, wherein by said sealing member pressing said projected portion against said developing roller so that a space formed by said developing blade and said sealing member in the developer accommodating portion is reduced.

13. A process cartridge according to claim 5, wherein by said sealing member pressing said projected portion against said developing roller so that a space formed by said developing blade and said sealing member in the developer accommodating portion is reduced.

14. An apparatus according to claim 9, wherein by said sealing member pressing said projected portion against said developing roller so that a space formed by said developing blade and said sealing member in the developer accommodating portion is reduced.

15. An apparatus according to claim 1, wherein said sealing member is disposed outside said longitudinal end with respect to the lengthwise direction.

16. An apparatus according to claim 5, wherein said sealing member is disposed outside said longitudinal end with respect to the lengthwise direction.

17. An apparatus according to claim 9, wherein said sealing member is disposed outside said longitudinal end with respect to the lengthwise direction.

* * * * *